US005576170A

United States Patent [19]

Eikenberry et al.

[11] Patent Number: 5,576,170

[45] Date of Patent: Nov. 19, 1996

[54] PHOTOGRAPHIC ELEMENT AND METHOD OF MAKING A SILVER HALIDE EMULSION

[75] Inventors: Jon N. Eikenberry, Rochester; Robert E. Bernard, Victor, both of N.Y.

[73] Assignee: Eastman Kodak Company, Rochester, N.Y.

[21] Appl. No.: 430,954

[22] Filed: Apr. 28, 1995

[51] Int. Cl.[6] ..... G03C 1/08; G03C 1/09; G03C 1/34

[52] U.S. Cl. ..... 430/567; 430/569; 430/600; 430/603; 430/607; 430/611; 430/614

[58] Field of Search ..... 430/569, 600, 430/603, 607, 614, 611, 567, 599

[56] References Cited

U.S. PATENT DOCUMENTS

| | | | |
|---|---|---|---|
| 3,236,652 | 2/1966 | Kennard et al. | 96/109 |
| 3,300,312 | 1/1967 | Willems et al. | 96/85 |
| 4,378,426 | 3/1983 | Lok et al. | 430/505 |
| 4,451,557 | 5/1984 | Lok et al. | 430/505 |
| 4,847,187 | 7/1989 | Ono et al. | 430/607 |
| 5,190,855 | 3/1993 | Toya et al. | 430/599 |
| 5,294,532 | 3/1994 | Ito et al. | 430/588 |
| 5,389,510 | 2/1995 | Preddy et al. | 430/600 |
| 5,399,479 | 3/1995 | Lok | 430/600 |
| 5,411,854 | 5/1995 | Brust et al. | 430/600 |
| 5,413,905 | 5/1995 | Lok et al. | 430/600 |

FOREIGN PATENT DOCUMENTS

| | | | |
|---|---|---|---|
| 2422772 | 1/1975 | Germany | 430/600 |

*Primary Examiner*—Lee C. Wright
*Attorney, Agent, or Firm*—Peter C. Cody; Sarah Meeks Roberts

[57] ABSTRACT

A photographic element comprising a support having situated thereon a silver halide emulsion, the emulsion comprising an alkynylamine compound of the formula:

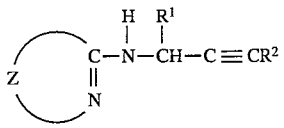

(I)

wherein Z represents atoms necessary to complete a 5 to 10-membered heterocyclic ring system, $R^1$ represents hydrogen or an alkyl of from 1 to 5 carbon atoms, and $R^2$ represents hydrogen, or an alkyl, aryl, heteroaryl, carbocyclic or heterocyclic group; and at least one dihydroxy aryl compound represented by formula II or III:

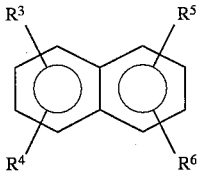

(II)

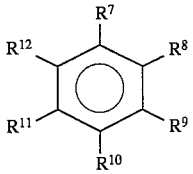

(III)

wherein $R^3$ to $R^{12}$ are independently selected from the group consisting of hydrogen, hydroxy, sulfonate, or an alkyl of from 1 to 5 carbon atoms, and wherein at least two of such groups represent a hydroxy group.

16 Claims, No Drawings

PHOTOGRAPHIC ELEMENT AND METHOD OF MAKING A SILVER HALIDE EMULSION

FIELD OF THE INVENTION

This invention relates to photographic elements and to methods of making photographic emulsions. In particular, this invention relates to silver halide photographic elements exhibiting improved sensitivity and fog performance, and to methods of making the photographic emulsions contained within such elements.

BACKGROUND OF THE INVENTION

Photography is the science of capturing an image on a tangible medium by exposure of a light sensitive material to actinic radiation and subsequent processing of the material to produce a visible image. Typically, silver halide is utilized as the light sensitive component of the light sensitive material. Upon exposure, it forms what is known in the art as a latent image, which is the invisible precursor of the useful visible image that appears during photographic processing. The latent image, and more specifically the metallic silver which comprises the latent image, serves to catalyze the reduction of silver ions to silver metal during processing, thus forming the visible image in black and white photographic materials, and forming dye precursors to the visible image in color negative or color reversal photographic materials.

Because the formation of images in photography is dependent upon the exposure of a light sensitive material to actinic radiation, it follows that the formation of images can be impacted by either the level of actinic radiation or the inherent sensitivity of the light sensitive material. The level of actinic radiation—i.e., the brightness of the scene that is to be recorded—is often outside of the control of the photographer, except perhaps to the extent that it may be partially controlled by the use of flashes and the like. The sensitivity of the light sensitive material, on the other hand, may be selected by the photographer to record an image under a given set of conditions.

Current photographic materials exhibit sensitivities that are much higher than their predecessors. However, the industry remains focused on improving the sensitivities of its products even further.

It has been recognized in the art that photographic sensitivity can be increased by adjusting the pH and/or the pAg of a silver halide emulsion. It has also been known that enhanced photographic sensitivity can be obtained by the addition of certain types of compounds called chemical sensitizers to photographic emulsions. Transition metal complexes such as platinum, iridium, osmium and rhodium complexes have been utilized to improve sensitivity. Often, these complexes or similar ones are added during the formation (precipitation) of the silver halide grains which serve as the light sensitive component of the light sensitive material. More often, though, they are added after the formation of the silver halide grains in a step(s) called chemical and spectral sensitization. It is during this step(s) that compounds added to the emulsion can interact with the surfaces of the silver halide grains to affect the grains' photographic properties.

One class of compounds typically added during chemical or spectral sensitization to improve sensitivity is the reduction sensitizers. Reduction sensitization is the sensitization of a photographic emulsion by application of a reduction sensitizer. It is also the process of improving a photographic emulsion's sensitivity by forming the emulsion under certain conditions. Specific examples of reduction sensitizers, such as dimethylamine borane, stannous chloride and hydrazine, are discussed by S. Collier in Photographic Science and Engineering, 23, 113 (1979). This reference also discusses various processes and conditions which, when present during emulsion formation, produce reduction sensitization. Such processes and conditions include the ripening of silver halide grains under conditions of high pH (pH 8–11) or low pAg (pAg 1–7).

Some of the more useful reduction sensitizers known belong to a class of compounds called alkynylamines. The photographic activity of this class has been extensively explored in the art and is described in, for example, U.S. Pat. Nos. 4,378,426 and 4,451,557. Alkynylamines are also described in allowed U.S. Pat. Nos. 5,399,479 and 5,389,510.

Although reduction sensitizers such as the alkynylamines are useful for improving sensitivity, they are also known to have the potential for causing an increase in a photographic emulsion's fog levels. Fog is an indiscriminate and undesirable reduction of silver ions to silver atoms. The silver atoms give rise during development to a generally or locally developed density that is not associated with the action of the image forming exposure; and it is this density which is termed fog.

To correct this deficiency of alkynylamines and other reduction sensitizers, it would be desirable to combine them with compounds capable of countering their adverse characteristics. This would enable the construction of photographic emulsions which exhibit not only improved sensitivity, but an adequate resistance to fog formation. In allowed U.S. patent application Ser. No. 08/168,892 (Docket 66,245PCC-01), discussed above, alkynylamines are utilized in combination with thiosulfonate and sulfinate antifoggants to improve the stability of a photographic emulsion during its storage (incubation). However, this combination has proven to be inadequate for providing sufficient reduction sensitization while controlling both incubational and fresh fog.

In addition to thiosulfonates and sulfinates, other types of antifoggants and stabilizers are known in the art. Examples of these compounds can be found in *Research Disclosure* 308119, published December 1989. Also, in U.S. Pat. No. 3,300,312, sulfosalicylic acid compounds are described which eliminate spot defects in photographic emulsions caused by metal contamination. Similarly, in U.S. Pat. No. 3,236,652, certain disulfonaphthalene and disulfocatechol salts are described as stabilizing the sensitometric properties of a photographic emulsion against the effects of transition metals. These compounds, however, fail to provide sensitization or antifogging to fresh emulsions.

SUMMARY OF THE INVENTION

It is an object of this invention to provide a photographic element containing a silver halide emulsion that exhibits improved sensitivity and stability.

It is a further object of this invention to provide a method of making a photographic emulsion which results in an emulsion exhibiting improved sensitivity and stability.

These and other objects of this invention, which will become apparent below, are provided by a photographic element comprising a support having situated thereon a silver halide emulsion, the emulsion comprising an alkynylamine compound of the formula:

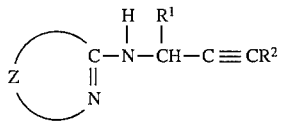

(I)

wherein Z represents atoms necessary to complete a 5 to 10-membered heterocyclic ring system, $R^1$ represents hydrogen or an alkyl of from 1 to 5 carbon atoms, and $R^2$ represents hydrogen, or an alkyl, aryl, heteroaryl, carbocyclic or heterocyclic group; and at least one dihydroxy aryl compound represented by formula II or III:

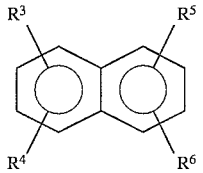

(II)

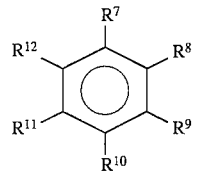

(III)

wherein $R^3$ to $R^{12}$ are independently selected from the group consisting of hydrogen, hydroxy, sulfonate, or an alkyl of from 1 to 5 carbon atoms, and wherein at least two of such groups represent a hydroxy group.

The invention also provides a method of forming a silver halide emulsion comprising precipitating silver halide grains in an aqueous colloidal medium, washing the grains, sensitizing the grains by adding dyes, chemical sensitizers, and heating, and adding to the emulsion, prior to heating, an alkynylamine compound and a dihydroxy aryl compound of the above-described formulas.

This invention overcomes the deficiencies of the prior art which failed to provide a means by which to obtain both improved sensitivity and stability in photographic elements containing silver halide emulsions. In particular, the invention improves upon the state of the art by providing photographic emulsions which exhibit an optimum fresh fog/sensitivity performance.

DETAILED DESCRIPTION OF THE INVENTION

As described, the present invention concerns silver halide elements which contain a combination of photographically active compounds that are capable of imparting to the element the desired characteristics of high sensitivity and low fog. The first of the compounds utilized in the invention is an alkynylamine compound of the formula:

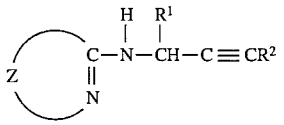

(I)

wherein Z represents atoms necessary to complete a 5 to 10-membered heterocyclic ring system, $R^1$ represents hydrogen or an alkyl of from 1 to 5 carbon atoms, and $R^2$ represents hydrogen, or an alkyl, aryl, heteroaryl, carbocyclic or heterocyclic group.

In formula (I), the 5- to 10-membered heterocyclic ring system formed by Z may be either a single ring or a condensed ring. Preferably it is a condensed ring such as a substituted or unsubstituted benzothiazole, benzoxazole, or benzoselenazole. Other groups contemplated to be within the scope of the invention for Z include pyrazole, imidazole, triazole, tetrazole, oxazole, isoxazole, thiazole, isothiazole, pyridine, tetrahydropyridine, pyrimidine, pyrazine, pyridazine, triazine, benzimidazole, benzotriazole, quinoline, isoquinoline, quinazoline, and phthalazine.

The group represented by Z may be substituted or unsubstituted. Examples of suitable substituents include alkyl groups (for example, methyl, ethyl, hexyl), aryl groups (for example, phenyl or tolyl), fluoroalkyl groups (for example, trifluoromethyl), alkoxy groups, (for example, methoxy, ethoxy, propoxy), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. Preferred are alkyl and alkoxy groups, preferably those having from 1 to 5 carbon atoms, and halogen atoms.

In formula (I), $R^1$ represents hydrogen or a lower alkyl having from 1 to 5 carbon atoms. It is preferred, though, that $R^1$ be hydrogen. $R^2$ can be hydrogen or an alkyl, aryl, heteroaryl, carbocyclic, or heterocyclic group. Preferably, it is hydrogen, a lower alkyl having from 1 to 5 carbon atoms, or an aryl group, such as phenyl or tolyl.

Suitable groups encompassed within the description of $R^2$ include the alkyl groups: methyl, ethyl, propyl, butyl, pentyl, hexyl, octyl, ethylhexyl, decyl, dodecyl, hexadecyl, octadecyl, isopropyl, t-butyl; the aryl and carbocyclic groups: phenyl, tolyl, naphthyl, cyclopentyl, cyclohexyl, cycloheptatrienyl, cyclooctatrienyl, and cyclononatrienyl; and the heterocylic and heteroaryl groups: pyrrole, furan, tetrahydrofuran, pyridine, picoline, piperidine, morpholine, pyrrolidine, thiophene, oxazole, thiazole, imidazole, selenazole, tellurazole, triazole, tetrazole, and oxadiazole.

Each of these groups may be substituted with groups that will not effect the photographic activity of the alkynylamine compound, such groups being readily determinable by one skilled in the art. Particular groups suitable for substitution on $R^1$ and $R^2$ include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. It is preferred that $R^1$ and $R^2$ be unsubstituted.

In a preferred embodiment of the present invention, the alkynylamine compound has the formula:

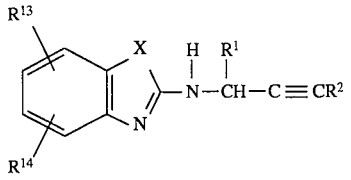

wherein X represents oxygen, sulfur, selenium, or an unsubstituted or alkyl substituted nitrogen; $R^1$ and $R^2$ are as defined previously; and $R^{13}$ and $R^{14}$ independently represent hydrogen, halogen, or a substituted or unsubstituted alkyl or alkoxy group, preferably one having fewer than 6 carbon atoms. Substituents can be as described previously for Z.

In a more preferred embodiment, $R^1$ and $R^2$ are as defined previously, and $R^{13}$ and $R^{14}$ are hydrogen or methyl. X is selected from the group consisting of oxygen, sulfur or selenium. Optimally, it is oxygen.

Specific compounds contemplated to be suitable as the alkynylamine compound of the invention include:

Compound IA: 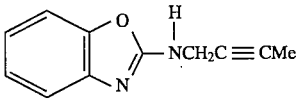

Compound IB: 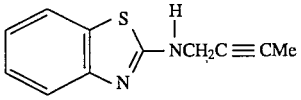

Compound IC: 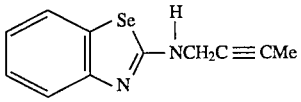

Compound ID: 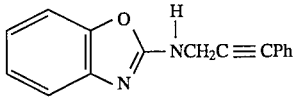

Compound IE: 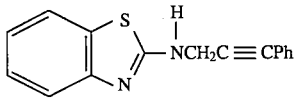

Compound IF: 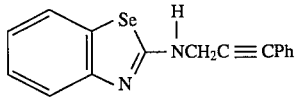

Compound IG: 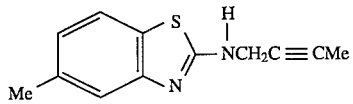

Compound IH: 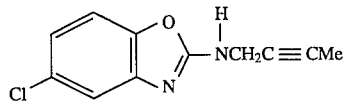

Compound II: 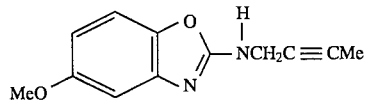

-continued

Compound IJ: 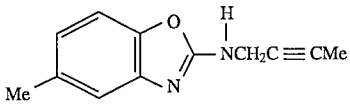

Compound IK: 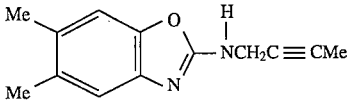

Compound IL: 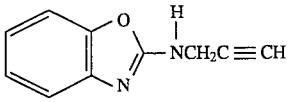

Compound IM: 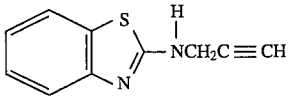

Compound IN: 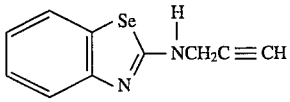

Compound IO: 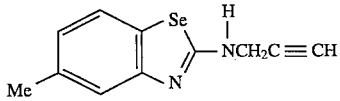

Compound IP: 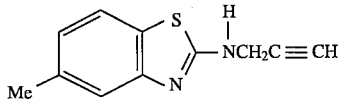

Compound IQ: 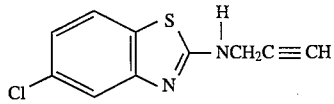

Compound IR: 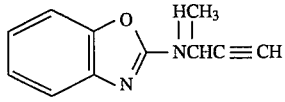

Compound IS: 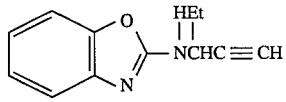

and

Compound IT: 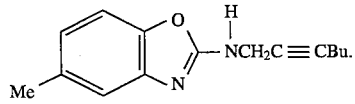

In the practice of the invention, it is also contemplated that the alkynylamine compound be water soluble; that is, that it further comprise a water solubilizing group. In this embodiment, the water solubilizing group can be substituted anywhere on the alkynylamine (e.g., as a substituent on $R^{13}$ or $R^{14}$). Preferably, it should be sufficient to enable the alkynylamine to be soluble at 0.1 grams per liter of water. Representative solubilizing groups include carboxy, carboxyalkyl, sulfo, sulfoalkyl, phosphato, phosphatoalkyl, phosphono, phosphonoalkyl, carbonamido, sulfonamido, hydroxy, and salts thereof. Preferably, the water solubilizing group is a carboxy or sulfo group, or salt thereof. Optimally, it is the sodium or potassium salt of a carboxy group.

The alkynylamine compounds utilized in the invention may be prepared by any methods known in the art. Examples of such methods can be found in U.S. Pat. Nos. 4,451,557 and 4,378,426, and in U.S. Pat. No. 5,389,510 all of which are incorporated herein by reference.

The photographic emulsions employed in this invention are generally prepared by precipitating silver halide crystals in an aqueous colloidal medium (matrix) by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Coating techniques known in the art include dip coating, air knife coating, curtain coating and extrusion coating.

For the purpose of improving the sensitivity of the emulsion, the alkynylamine compounds of the invention may be added to the silver halide emulsion at any time during the preparation of the emulsion. Preferably, they are added during the latter half of grain growth, during or before chemical sensitization or during final melting and co-mixing of the emulsion and additives for coating. It is most desired that the compounds be added prior to the heating step of chemical sensitization.

The alkynylamine compounds can be introduced to the emulsion at the appropriate time by any means commonly practiced in the art such as by dissolving in a convenient organic solvent, or by dispersing in a gelatin matrix. They may be added to the coupler melt which may be either dualed or combined with the emulsion melt during the coating process; to the vessel containing the aqueous gelatin salt solution before the start of the precipitation; or to a salt solution during precipitation. Other modes are also contemplated. Temperature, stirring, addition rates and other precipitation factors may be set within conventional ranges, by means known in the art, so as to obtain the desired physical characteristics.

The alkynylamine compounds can be incorporated into the emulsion in an amount between about 0.1 and about 200 milligrams per mole of silver halide. When the compounds are added during the precipitation of the emulsion's grains, they are preferably added in an amount between 1 and about 200 milligrams per mole of silver halide. When added during sensitization, it is more preferred to use a lesser amount, typically in the order of 0.1 to 100 milligrams per mole of silver halide. After sensitization, it is preferable to use an amount of the alkynylamine compound between about 1 and 200 milligrams per mole of silver halide.

In addition to the alkynylamine compounds, the present invention's photographic elements incorporate a dihydroxy aryl compound. It is this dihydroxy aryl compound which surprisingly has been found to counter the fogging deficiencies inherent in the use of the alkynylamines, particularly when it is added to the emulsion prior to the addition of the alkynylamine and prior to the heating Step of chemical sensitization. Further, the combination of the two compounds also provides for an increase in sensitivity that could not have been expected based upon the known individual effects of each compound.

The dihydroxy aryl compound is selected from a compound of Formula II or III:

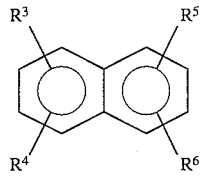

(II)

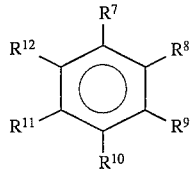

(III)

wherein $R^3$ to $R^{12}$ are independently selected from the group consisting of hydrogen, hydroxy, sulfonate, or an alkyl of from 1 to 5 carbon atoms, and wherein at least two of such groups represent a hydroxy group.

Preferably, the dihydroxy aryl is of the formula (III), wherein $R^7$ to $R^{12}$ are independently selected from the group consisting of hydrogen, hydroxy or sulfonate, and wherein at least two of such groups represent a hydroxy group and two other groups represent a sulfonate group.

Optimally, the dihydroxy aryl compound has the formula:

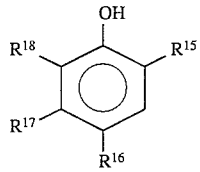

wherein one of $R^{15}$ or $R^{16}$ represents hydroxy group and the other represents a sulfonate group; and $R^{17}$ and $R^{18}$ independently represent hydrogen or a sulfonate group, with the proviso that at least one of $R^{17}$ or $R^{18}$ represents a sulfonate group.

Representative examples of the dihydroxy aryl compound suitable for use in the invention include:

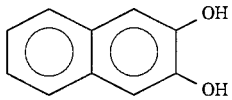

(IIA)

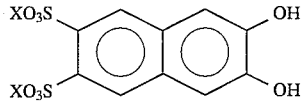

(IIB)

-continued (IIIA)

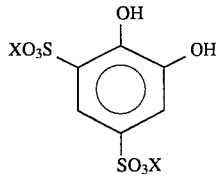

(IIIB)

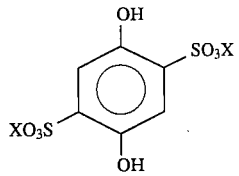

(IIIC)

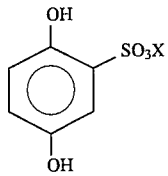

(IIID)

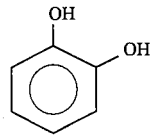

(IIIE)

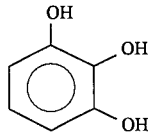

(IIIF)

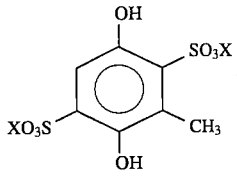

(IIIG)

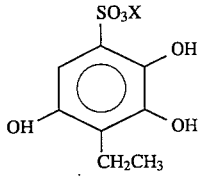

where X is a cation. Suitable cations include ammonium or alkali metals such as sodium or potassium.

These compounds and others within the scope of Formulas II and III can be prepared by methods known in the art. In particular, reference is made to Fukeyama et al, Japanese Patent 4327 ('52) and The Merck Index, p.1219, Ninth Edition, 1976, by Merck & Co., Inc., N.J., both incorporated herein by reference.

It is believed that the mechanism of action of dihydroxy aryl compound is through its interaction with selective redox reactions in a photographic emulsion. In this regard, it is contemplated that the compound be added to the emulsion in any manner that will allow it to adsorb to the surfaces of the emulsion's silver halide grains. The dihydroxy aryl compound can be added to the photographic emulsion in a similar manner as the alkynylamine compound. Preferably, though, the dihydroxy aryl compound is added to the emulsion concurrently with, or prior to, the addition of the alkynylamine compound. When used this way, it is contemplated that the compound be incorporated in an amount from about 0.1 to about 10000 milligrams per mole of silver halide. Preferably, it is incorporated in an amount from about 1 to about 2000 milligrams per mole of silver halide; and optimally, it is incorporated in an amount from about 10 to about 500 milligrams per mole of silver halide.

The emulsions employed in the photographic elements of the invention may incorporate any type of silver halide emulsion, for example silver bromide, silver chloride and silver iodide, or any mixtures thereof, such as silver iodobromide, silver iodochlorobromide, silver chlorobromide, and silver iodobromochloride. Preferably, though, the grains employed in the present invention are predominantly silver bromide grains, with the level of iodide in such grains preferably being less than about 8 mole percent.

By predominantly silver bromide, it is meant that such grains are greater than 50 mole percent silver bromide. Preferably, the silver bromide accounts for greater than about 75 mole percent, and more preferably greater than about 85 mole percent. The grains may also contain iodide up to about 40 mole percent, although as stated, it is preferred that iodide content be less than about 8 mole percent.

The emulsions may be conventional three-dimensional emulsions such as cubic, octahedral, or icositetrahedral. Ruffled and other irregular emulsions are also contemplated. Preferred are tabular grain emulsions having an aspect ratio exceeding 2:1, with at least 50% of the projected area being contributed by such grains. In a more preferred embodiment, the aspect ratio of the grains exceeds 5:1. Optimally, it exceeds 8:1. It is also contemplated that "ultrathin" tabular emulsions, such as those described in U.S. Pat. No. 5,250,403, be employed. These emulsions have {111} major faces that account for greater than about 97 percent of the total grain projected area. The tabular grains have an equivalent circular diameter (ECD) of at least 0.7 microns and a mean thickness of less than 0.07 microns. It is this thickness from which their name—ultrathin—is derived.

Other suitable emulsions are {111} tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (100) tabular silver chloride emulsions such as described in EPO 534,395, published Mar. 31, 1993 (Brust et al). {100} silver chloride tabular grains are also specifically contemplated.

In preparing tabular grain emulsions it is typically the practice to charge a reactor with a solution containing water, a peptizing agent, preferably bone gel, and a halide salt, preferably NaBr and KI. Optional ingredients may include, but are not limited to, strong mineral acids, certain polyalkylene oxide surfactants, and silver halide ripening agents, for example 1,8-dihydroxy-3,6-dithiaoctane. Nucleation of AgBr or AgBrI by double-jet addition of a soluble silver salt and a halide salt mixture with vigorous mixing occurs at a temperature between 30° C. and 50° C., with a pH<3.5, and a constant halide excess yielding a pAg of greater than 9.0 and less than 10.5. If used, iodide may be present at levels as described previously. A ripening agent may be used at levels up to 0.5 mole per mole of silver nucleated. Iodide may be introduced by uniform incorporation, discontinuous introduction of an iodide-rich seed emulsion or soluble iodide salt, or by any combination of these methods. Following nucleation, additional peptizer can be added and reactor conditions adjusted to achieve a temperature from 40° C. to 80° C., a pH from 3.0 to 7.0, and a pAg from 8.0 to 9.0. AgBrI (0<%I<10%) can then be precipitated by double-jet addition of soluble silver salt and mixed halide solutions, using constant and/or accelerated flow profiles. The iodide fraction may vary anywhere within the stated range during the remainder of precipitation.

The photographic elements of the invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like.

The photographic element may also contain a transparent magnetic recording layer such as a layer containing magnetic particles on the underside of a transparent support, as in U.S. Pat. Nos. 4,279,945 and 4,302,523 and *Research Disclosure*, November 1993, Item 3490, which are incorporated herein by reference. Typically, the element will have a total thickness (excluding the support) of from about 5 to about 30 microns.

In the following Table, reference will be made to (1)*Research Disclosure*, December 1978, Item 17643, (2)*Research Disclosure*, December 1989, Item 308119, (3)*Research Disclosure*, September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the photographic element according to the invention. The Table and its cited references also describe suitable ways of exposing, processing and manipulating the elements, and the images contained therein.

| Reference | Section | System Element(s) |
|---|---|---|
| 1 | I, II | Grain composition, morphology |
| 2 | I, II, IX, X, XI, XIII, XIV, XV | and preparation; Emulsion preparation including hardeners, |
| 3 | I, II, III, IX A & B | coating aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |

-continued

| Reference | Section | System Element(s) |
|---|---|---|
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

Specific dopants, such as compounds of copper, thallium, lead, bismuth, cadmium and Group VIII noble metals, can be present during process of the present invention or during preparation of silver halide grains employed in the emulsion layers of the photographic element. Other dopants include transition metal complexes as described in U.S. Pat. Nos. 4,981,781, 4,937,180, and 4,933,272.

The silver halide grains of the photographic element can further be surface-sensitized, and noble metal (e.g., gold), middle chalcogen (e.g., sulfur, selenium, or tellurium) and reduction sensitizers, employed individually or in combination, are specifically contemplated.

The silver halide grains can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, styryls, merostyryls, and streptocyanines.

The photographic elements can contain image and image-modifying couplers, brighteners, antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), anti-stain agents and image dye stabilizers, light absorbing and scattering materials, hardeners, polyalkyleneoxide and other surfactants as described in U.S. Pat. No. 5,236,817, coating aids, plasticizers and lubricants, anti-static agents, matting agents, development modifiers.

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible dye image as described above. Development is typically followed by the conventional steps of bleaching, fixing, or bleach-fixing, to remove silver or silver halide, washing, and drying.

The following examples illustrate the practice of this invention. They are intended to be illustrative, and therefore should not be taken as exhaustive of all possible variations of the invention.

EXAMPLES

Example 1

A series of thin, tabular iodobromide emulsions (1 to 3 μm×0.04 to 0.06 μm) containing 3% iodide prepared by running AgI together with $AgNO_3$ and NaBr under carefully controlled conditions of pH, gelatin content and vAg as described in U.S. Pat. No. 5,250,403 was sensitized as described in U.S. patent application Ser. No. 08/169,478 with 2-butynyl aminobenzoxazole (Compound IA). Sensitizations were also performed where sodium dithiosulfate and sodium aurous dithiosulfate replaced the sulfur and gold sources described in this patent application.

The specific sensitization procedure for Example 1 involved the sequential addition to a tabular grain emulsion (2.70×0.063 μm) of sodium thiocyanate, a finish modifier (3-(2-methylsulfamoylethyl)benzothiazolium tetrafluoroborate), a methanol solution of a yellow sensitizing dye (anhydro-5,5'-dichloro-3,3'-bis(3-sulfopropyl)thiacyanine hydroxide, triethylammonium salt), optionally a dihydroxy aryl compound (IIIA) and alkynylamine compound (IA), followed by sulfur and gold sensitization with sodium aurous thiosulfate and sodium thiosulfate. The emulsion was then incubated at 65° C. for 5 minutes, cooled to 40° C., and 1-(3-acetamidophenyl)-5-mercaptotetrazole was added followed by 5-bromo-4-hydroxy-6-methyl-1,3,3A,7-tetraazaindene.

The emulsion was coated in a simple single layer format over a pad of gelatin with a gelatin overcoat to protect the coating from abrasion. The emulsion layer contained both a yellow image forming coupler and a yellow development inhibitor releasing coupler.

The performance of the emulsion in a coated format with and without the alkynylamine compound, and with or without the dihydroxy aryl compound, is shown in Table 1 following Example 2.

Example 2

Example 2 was identical to Example 1 except the dimensions of the tabular grains of the emulsion were 3.20×0.057 μm, the yellow sensitizing dye added was anhydro-5-chloro-5'-phenyl-3,3'-bis(3-sulfopropyl)oxathiacyanine hydroxide, triethylammonium salt, and 1-(3-acetamidophenyl)-5-mercaptotetrazole was added directly before the dihydroxy aryl compound. The data from Examples 1 and 2 are shown below in Table 1.

Table 1 demonstrates that when an alkynylamine compound is added to the sensitization (Example 1b), an increase in speed (relative to the control Example 1a) is obtained and it is accompanied by a substantial increase in fog. When the same addition of alkynylamine is performed in the presence of the dihydroxy aryl compound, however, the speed increase realized is unexpectedly much larger and it is accompanied by much less fog (Example 1d and 2d). In this regard, it should be noted that when the dihydroxy aryl compound is added in the absence of the alkynylamine (Example 1c and 2c), the fog level is not suppressed.

TABLE 1

| Emulsion | Alkynylamine (Ia) (mg/mole) | Sulfohydroxy aryl (IIIA) (mg/mole) | Fog* | Speed** |
|---|---|---|---|---|
| 1a | 0 | 0 | 0.08 | 267 |
| 1b | 4 | 0 | 0.38 | 280 |

TABLE 1-continued

| Emulsion | Alkynylamine (Ia) (mg/mole) | Sulfohydroxy aryl (IIIA) (mg/mole) | Fog* | Speed** |
|---|---|---|---|---|
| 1c | 0 | 300 | 0.09 | 275 |
| 1d | 4 | 300 | 0.12 | 298 |
| 2a | 0 | 0 | 0.12 | 248 |
| 2b | 5 | 0 | 0.78 | 268 |
| 2c | 0 | 300 | 0.12 | 258 |
| 2d | 5 | 300 | 0.32 | 283 |

*measured as Dmin including the film base.
**measured as 100(1-logH) where H is the exposure in lux-sec necessary to produce a density 0.15 above Dmin.

Example 3

Example 3 was identical to Example 1 except that during sensitization, the sensitizing dye was added as a dispersion in gelatin rather than as a methanol solution and 1,3-dicarboxymethyl-1,3-dimethyl-2-thiourea was used as the sulfur source as described in U.S. Pat. No. 4,810,626 and aurous bis(1,4,5-trimethyl-1,2,4-triazolium-3-thiolate) was used as the gold source as described in U.S. Pat. No. 5,049,485. Also, the incubation was for 15 min at 55° C. 1-(3-acetamidophenyl)-5-mercaptotetrazole was added after the heat incubation.

Table 2 below illustrates the ability of the combination of alkynylamine compound and dihydroxy aryl compound to control fog and increase speed over a range of alkynylamine levels.

TABLE 2

| Emulsion | Alkynylamine (Ia) (mg/mole) | Dihydroxy aryl (IIIA) (mg/mole) | Fog* | Speed** |
|---|---|---|---|---|
| 3a | 0 | 0 | 0.06 | 223 |
| 3b | 0 | 1000 | 0.07 | 223 |
| 3c | 1 | 0 | 0.45 | 243 |
| 3d | 1 | 1000 | 0.08 | 257 |
| 3e | 2 | 0 | 0.50 | 223 |
| 3f | 2 | 1000 | 0.09 | 263 |
| 3f | 2 | 0 | 1.28 | 166 |
| 3g | 4 | 1000 | 0.10 | 269 |
| 3h | 6 | 0 | 0.80 | 223 |
| 3i | 6 | 1000 | 0.11 | 275 |

*measured as Dmin including the film base.
**measured as 100(1-logH) where H is the exposure in lux-sec necessary to produce a density 0.15 above Dmin.

Example 4

Example 4 was identical to Example 1 except that the sensitizing components were varied and were added during chemical sensitization in the amount shown in Table 3 (except for BrTAI, which was added after chemical sensitization). The advantages of the present invention over combinations of alkynylamine compounds and other known antifoggants/stabilizers was explored in this example. The results are shown below in Table 3. All levels in Table 3 are shown in terms of mg/mole silver.

TABLE 3

| Emulsion | Bnzt[1] | APMT[2] | Dihydroxy aryl (IIIA) | Alkynylamine (IA) | BrTAI[3] | Dmin[4] | Speed[4] | ΔDmin | ΔSpeed |
|---|---|---|---|---|---|---|---|---|---|
| 4 | 40 | 20 | 0 | 0 | 400 | 0.087 | 275 | | |
| 5 | 40 | 20 | 0 | 6 | 400 | 0.311 | 300 | 0.224 | 25 |
| 6 | 40 | 20 | 300 | 0 | 400 | 0.105 | 284 | | |
| 7 | 40 | 20 | 300 | 6 | 400 | 0.145 | 312 | 0.040 | 28 |
| 8 | 80 | 20 | 300 | 6 | 400 | 0.081 | 273 | | |
| 9 | 80 | 20 | 0 | 6 | 400 | 0.210 | 287 | 0.129 | 14 |
| 10 | 40 | 40 | 0 | 0 | 400 | 0.098 | 277 | | |
| 11 | 40 | 40 | 0 | 6 | 400 | 0.332 | 291 | 0.234 | 14 |
| 12 | 40 | 20 | 0 | 0 | 800 | 0.115 | 280 | | |
| 13 | 40 | 20 | 0 | 6 | 800 | 0.294 | 301 | 0.179 | 21 |

[1]3-(2-methylsulfamoylethyl)-benzothiazolium tetrafluoroborate
[2]1-(3-acetamidophenyl)-5-mercaptotetrazole
[3]4-hydroxy-5-bromo-6-methyl-1,3,3a,7-tetra-azaindene
[4]Dmin and Speed are defined in preceding Tables.

Table 3 demonstrates the unique advantages in terms of fog and speed control that are obtainable by practice of the present invention. These advantages are not obtainable when the dihydroxy aryl compound is substituted by a different antifoggant.

In Example 5, shown below, a series of emulsions containing different dihydroxy aryl compounds in combination with an alkynylamine compound were prepared and tested in a manner similar to that described above.

Example 5

A series of emulsions were prepared as in Example 1 except that the dihydroxy aryl compound was varied in terms of type and level, and the yellow sensitizing dye was added as a dispersion in gelatin.

Table 4 below demonstrates the results of this Example. As can be seen, multiple forms of dihydroxy aryl compounds are suitable for use in the invention.

TABLE 4

| Example | Alkynylamine (IA) (mg/mole) | Dihydroxy aryl (mg/mole) | Dmin[1] | Speed[1] |
|---|---|---|---|---|
| 14 | 0 | — | 0.093 | 266 |
| 15 | 4 | — | 0.975 | 271 |

TABLE 4-continued

| Example | Alkynylamine (IA) (mg/mole) | Dihydroxy aryl (mg/mole) | Dmin[1] | Speed[1] |
|---|---|---|---|---|
| 16 | 4 | IIIA (100) | 0.168 | 315 |
| 17 | 4 | IIIA (300) | 0.170 | 315 |
| 18 | 4 | IIIB (10) | 0.196 | 298 |
| 19 | 4 | IIIC (10) | 0.593 | 296 |
| 20 | 4 | IIID (10) | 0.299 | 295 |
| 21 | 4 | IIIE (100) | 0.328 | 287 |
| 22 | 4 | IIA (1) | 0.251 | 301 |

[1]Speed and Dmin are defined in preceding Tables.

Example 6

A series of Emulsions were prepared as in Example 3 except that finish modifier 3-(2-methylsulfamoylethyl)-benzothiazolium tetrafluoroborate was not included, and the only antifoggants/stabilizers present during chemical sensitization were as shown in Table 5 below. Levels are expressed in terms of mg/mole silver. As can be seen from the data, the combination of alkynylamine compound and dihydroxy aryl compound provides optimum results.

TABLE 5

| Emulsion | Alkynylamine Compound (IA) | APMT[1] | BrTAI[2] | DPD[3] | Sulfohydroxy aryl (IIIA) | Dmin[4] | Speed[4] |
|---|---|---|---|---|---|---|---|
| 23 | 4 | 0 | — | — | — | .921 | 222 |
| 24 | 4 | 50 | — | — | — | .764 | 236 |
| 25 | 4 | 100 | — | — | — | .837 | 223 |
| 26 | 4 | 200 | — | — | — | .559 | 125 |
| 27 | 4 | 400 | — | — | — | .056 | 106 |
| 28 | 4 | — | 0 | — | — | .999 | 213 |
| 29 | 4 | — | 200 | — | — | .690 | 245 |
| 30 | 4 | — | 400 | — | — | .102 | 172 |
| 31 | 4 | — | 800 | — | — | .065 | 148 |
| 32 | 4 | — | 1600 | — | — | .055 | 132 |
| 33 | 4 | — | — | — | — | .886 | 226 |
| 34 | 4 | — | — | 10 | — | .103 | 222 |
| 35 | 4 | — | — | 20 | — | .079 | 212 |
| 36 | 4 | — | — | 40 | — | .074 | 206 |
| 37 | 4 | — | — | 80 | — | .070 | 206 |
| 38 | 4 | — | — | — | — | .481 | 244 |
| 39 | 4 | — | — | — | 100 | .130 | 278 |
| 40 | 4 | — | — | — | 250 | .087 | 275 |

TABLE 5-continued

| Emulsion | Alkynylamine Compound (IA) | APMT[1] | BrTAI[2] | DPD[3] | Sulfohydroxy aryl (IIIA) | Dmin[4] | Speed[4] |
|---|---|---|---|---|---|---|---|
| 41 | 4 | — | — | — | 500 | .084 | 274 |
| 42 | 4 | — | — | — | 1000 | .073 | 274 |

[1]1-(3-acetamidophenyl)-5-mercaptotetrazole
[2]5-bromo-4-hydroxy-6-methyl-1,3,3A,7-tetraazaindene
[3]4,4'-dephenyl disulfide diacetanilide
[4]Dmin and Speed are defined in preceding Tables.

The invention has been described in detail with particular reference to preferred embodiments thereof, but it will be understood that variations and modifications can be effected within the spirit and scope of the invention.

What is claimed is:

1. A photographic element comprising a support having situated thereon a silver halide emulsion, the emulsion comprising an alkynylamine compound of the formula:

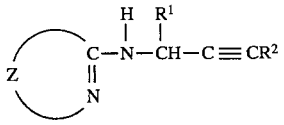

(I)

wherein Z represents atoms necessary to complete a 5 to 10-membered heterocyclic ring system, $R^1$ represents hydrogen or an alkyl of from 1 to 5 carbon atoms, and $R^2$ represents hydrogen, or an alkyl, aryl, heteroaryl, carbocyclic or heterocyclic group; and at least one dihydroxy aryl compound of the formula:

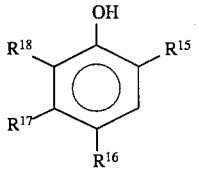

wherein one of $R^{15}$ or $R^{16}$ represents a hydroxy group and the other represents a sulfonate group; and $R^{17}$ and $R^{18}$ independently represent hydrogen, an alkyl group having 1 to 5 carbon atoms or a sulfonate group with the proviso that at least one of $R^{17}$ or $R^{18}$ represents a sulfonate group;

wherein the dihydroxy aryl compound has been added to the emulsion prior to the heating step of chemical sensitization.

2. A photographic element according to claim 1 wherein the alkynylamine compound is of the formula:

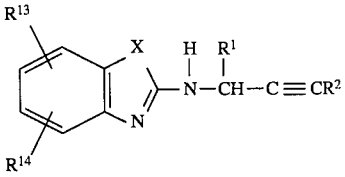

wherein X represents oxygen, sulfur, selenium, or an unsubstituted or alkyl substituted nitrogen; $R^1$ and $R^2$ are as defined in claim 1; and $R^{13}$ and $R^{14}$ independently represent hydrogen, halogen, or an alkyl or alkoxy group.

3. A photographic element according to claim 2 wherein $R^2$ is selected from the group consisting of hydrogen, an alkyl of from 1 to 5 carbon atoms, or an aryl group.

4. A photographic element according to claim 3 wherein the alkynylamine compound is selected from the group consisting of Compound IA:

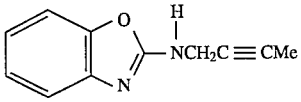

Compound IB:

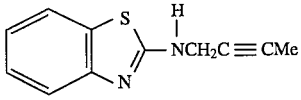

Compound IC:

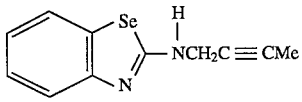

Compound ID:

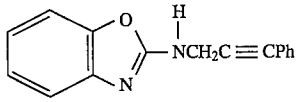

Compound IE:

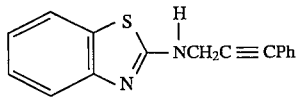

Compound IF:

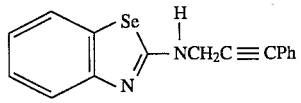

Compound IG:

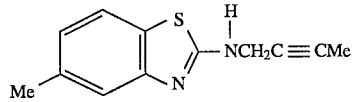

Compound IH:

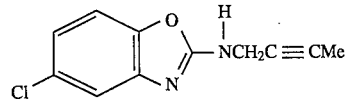

Compound II:

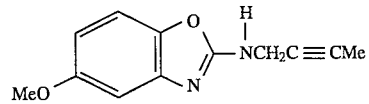

Compound IJ:

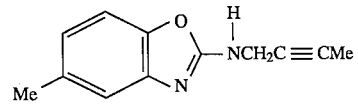

Compound IK:

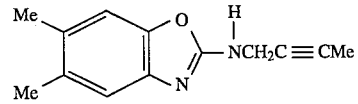

-continued

Compound IL:

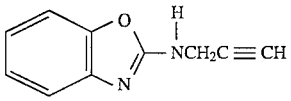

Compound IM:

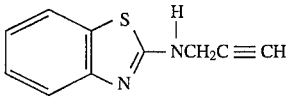

Compound IN:

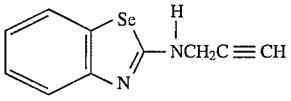

Compound IO:

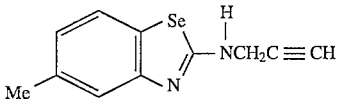

Compound IP:

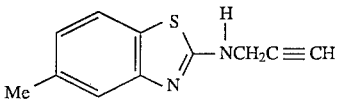

Compound IQ:

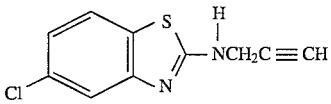

Compound IR:

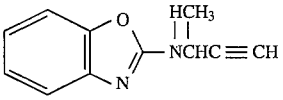

Compound IS:

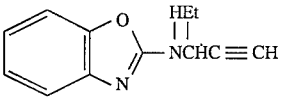

and

Compound IT:

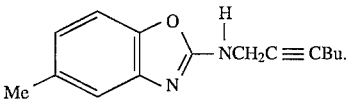

5. A photographic element according to claim 4 wherein the alkynylamine compound is selected from the group consisting of Compound IA:

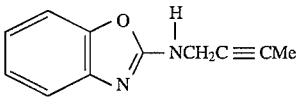

Compound ID:

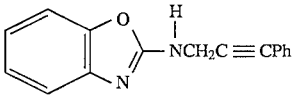

and

Compound IL:

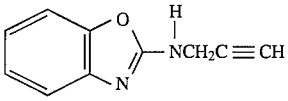

6. A photographic element according to claim 5 wherein the emulsion comprises silver halide grains which are formed or sensitized in the presence of the alkynylamine compound.

7. A photographic element according to claim 6 wherein the silver halide grains are silver bromoiodide tabular grains having an iodide content of less than about 8 mole percent.

8. A photographic element according to claim 7 wherein the emulsion contains the alkynylamine compound in an amount from about 0.1 to about 200 milligrams per mole silver halide.

9. A photographic element according to claim 1 wherein the dihydroxy aryl compound is

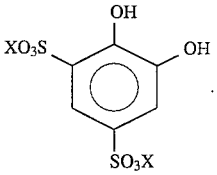

where X is a cation.

10. A photographic element according to claim 9 wherein the emulsion contains the dihydroxy aryl compound is an amount between about 0.1 and about 10000 milligrams per mole silver halide.

11. A method of forming a silver halide emulsion comprising precipitating silver halide grains in an aqueous colloidal medium, washing the grains, and sensitizing the grains by adding dyes, chemical sensitizers, and heating, and adding to the emulsion, prior to heating, an alkynylamine compound of the formula:

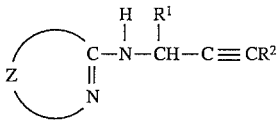

(I)

wherein Z represents atoms necessary to complete a 5 to 10-membered heterocyclic ring system, $R^1$ represents hydrogen or an alkyl of from 1 to 5 carbon atoms, and $R^2$ represents hydrogen, or an alkyl, aryl, heteroaryl, carbocyclic or heterocyclic group; and a dihydroxy aryl compound of the formula

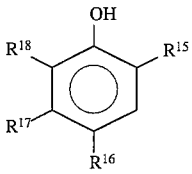

wherein one of $R^{15}$ or $R^{16}$ represents hydroxy group and the other represents a sulfonate group; and $R^{17}$ and $R^{18}$ independently represent hydrogen or a sulfonate group with the proviso that at least one of $R^{17}$ or $R^{18}$ represents a sulfonate group.

12. A method according to claim 11 wherein the alkynylamine compound is of the formula:

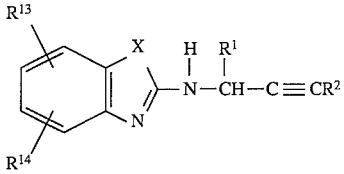

wherein X represents oxygen, sulfur, selenium, or an unsubstituted or alkyl substituted nitrogen; $R^1$ and $R^2$ are as defined in claim 14; and $R^{13}$ and $R^{14}$ independently represent hydrogen, halogen, or an alkyl or alkoxy group.

13. A method according to claim 12 wherein the dihydroxy aryl compound is added to the emulsion concurrently with, or prior to, the addition of the alkynylamine compound.

14. A method according to claim 13 wherein the silver halide grains are silver bromoiodide tabular grains having an iodide content of less than about 8 mole percent and an aspect ratio greater than 2.

15. A method according to claim 14 wherein the alkynylamine is

Compound IA:

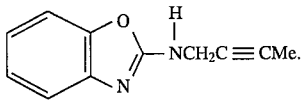

16. A method according to claim 15 wherein the alkynylamine compound is added during sensitization in an amount from about 0.1 to about 200 milligrams per mole silver halide.

* * * * *